US009151104B2

(12) United States Patent
Gaviglia

(10) Patent No.: US 9,151,104 B2
(45) **Date of Patent: *Oct. 6, 2015**

(54) WIDE CHANNEL KNIFE EDGE DOOR AND DOOR FRAME SYSTEM

(71) Applicant: Gaven Industries, Inc., Saxonburg, PA (US)

(72) Inventor: John J. Gaviglia, Glenshaw, PA (US)

(73) Assignee: Gaven Industries, Inc., Saxonburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/016,569

(22) Filed: Sep. 3, 2013

(65) Prior Publication Data

US 2014/0000209 A1 Jan. 2, 2014

Related U.S. Application Data

(62) Division of application No. 13/104,278, filed on May 10, 2011, now Pat. No. 8,522,484.

(60) Provisional application No. 61/395,240, filed on May 10, 2010.

(51) Int. Cl.
*E06B 1/18* (2006.01)
*E06B 7/16* (2006.01)
(Continued)

(52) U.S. Cl.
CPC ... *E06B 1/18* (2013.01); *E06B 1/52* (2013.01); *E06B 7/2301* (2013.01); *Y10T 29/49623* (2015.01)

(58) Field of Classification Search
CPC ..... E06B 7/2301; E06B 1/18; E06B 1/52; B21D 53/74; Y10T 29/49623
USPC ..... 49/381, 394, 397, 400, 401, 402, 483.1, 49/484.1; 174/367, 368, 374; 292/137, 292/138, 142, 143, 172
See application file for complete search history.

(56) References Cited

U.S. PATENT DOCUMENTS 2,019,664 A 11/1935 Farmer
3,055,969 A 9/1962 Schaller, Jr.
(Continued)

OTHER PUBLICATIONS

Department of Defense, High-Altitude Electromagnetic Pulse (HEMP) Protection for Ground-Based C4I Facilities Performing Critical, Time-Urgent Missions, Part 1 Fixed Facilities; MIL-STD-188-125-1-1; Jul. 17, 1998.
(Continued)

*Primary Examiner* — Sarang Afzali
(74) *Attorney, Agent, or Firm* — David G. Oberdick

(57) ABSTRACT

The present invention is a wide channel door frame cooperating with a wide width knife edge of a door and latching mechanism: to accommodate a gap between finger stock seals when the wide knife edge door is in the open position, to provide electrical connectivity between the door and door frame when the wide knife edge door is received into the wide channel door frame in the closed position, to accommodate ease of manufacturing a straight channel, to accommodate ease of cleaning the channel after installation of the finger stock seals, and to accommodate ease of closing/latching and opening/delatching the door. An alternative embodiment includes a third strip of beryllium copper finger stock seals attached to the base of the channel for increased electrical conductivity or the addition of weather seals for exterior applications. Wide channels and knife edges can be made of desirable material, for example 304 stainless steel.

4 Claims, 16 Drawing Sheets

(51) Int. Cl.
*E06B 7/23* (2006.01)
*E06B 1/52* (2006.01)

(56) References Cited

U.S. PATENT DOCUMENTS

| | | | | | |
|---|---|---|---|---|---|
| 3,132,893 | A | | 5/1964 | Madland | |
| 3,437,735 | A | | 4/1969 | Schaller | |
| 4,129,307 | A | * | 12/1978 | Nishiura et al. | 277/646 |
| 4,561,209 | A | | 12/1985 | Sohlstrom | |
| 4,571,449 | A | | 2/1986 | Lindenberger | |
| 4,691,483 | A | | 9/1987 | Anderson | |
| 4,750,569 | A | | 6/1988 | Flogaus | |
| 4,902,851 | A | | 2/1990 | Richter | |
| 4,929,802 | A | | 5/1990 | Schaepers et al. | |
| 5,223,670 | A | | 6/1993 | Hogan | |
| 5,250,751 | A | | 10/1993 | Yamaguchi | |
| 5,553,871 | A | * | 9/1996 | Rowe et al. | 277/644 |
| 5,736,671 | A | | 4/1998 | Perala | |
| 6,323,419 | B1 | | 11/2001 | Toy | |
| 6,914,184 | B1 | | 7/2005 | Lahita | |
| 7,152,375 | B1 | | 12/2006 | Mastro | |
| 7,491,898 | B2 | | 2/2009 | Villanella | |
| 2007/0151162 | A1 | | 7/2007 | Thielmann et al. | |
| 2011/0271598 | A1 | * | 11/2011 | Gaviglia | 49/383 |

OTHER PUBLICATIONS

Department of Defense, High-Altitude Electromagnetic Pulse (HEMP) Protection for Ground-Based C4I Facilities Performing Critical, Time-Urgent Missions, Part 2 Transportable Systems; MIL-STD-188-125-2-2; Mar. 3, 1999.

Office Action for U.S. Appl. No. 13/104,278 dated Oct. 23, 2012.

Office Action for U.S. Appl. No. 13/104,278 dated Nov. 23, 2012.

* cited by examiner

WIDE CHANNEL KNIFE EDGE DOOR AND DOOR FRAME SYSTEM

CROSS-REFERENCE TO RELATED APPLICATIONS

This application is Divisional Application of U.S. Non-provisional application Ser. No. 13/104,278, titled WIDE CHANNEL KNIFE EDGE DOOR AND DOOR FRAME SYSTEM, filed on May 10, 2011, which is a Non-provisional application of U.S. Provisional Application No. 61/395,240, titled WIDE CHANNEL KNIFE EDGE DOOR AND DOOR FRAME SYSTEM, filed on May 10, 2010, both herein incorporated by reference.

FIELD OF THE INVENTION

This invention relates to a knife edge door and door frame system, and particularly, to a wide channel knife edge door and door frame system.

BACKGROUND OF THE INVENTION

A narrow channel knife-edge door design has numerous disadvantages. Because the knife and channel are made of brass, corrosion occurs and creates non conductive zinc and copper oxides.

In addition, the channel traps water dirt and contaminants, whereby performance degrades exponentially. Also, the channel is extremely difficult to clean. Typically, cleaning requires removal of the finger stock seal in the narrow channel (that is, brass receiving "fingers" that help create an electrical seal with the knife edge in the channel). The finger stock seal, when removed, often gets damaged and cannot be reused. Also, all corrosion has to be removed from narrow channel and knife edge surfaces, which is difficult. A conductive lubricant can be used on the brass surfaces to slow corrosion. However, the silicone lubricant traps and holds dirt and dust particles reducing shielding effectiveness.

Additionally, water freezes in narrow channel rendering the door inoperable in cold climates. Moreover, the knife edge can wear below serviceable limits in dry sandy environments requiring replacement of entire door within 5 years.

Large lever and cam mechanisms are required to open and close the knife edge door. Appreciable wear on the finger stock seal and knife edge occurs because of this mechanical opening action. There are two conditions that make the door difficult to operate: 1—the beryllium copper finger stock seal are heat treated, or tempered, to make them springy. This process also hardens them. When the surface of the finger stock seal begins to wear and become microscopically abraded, it digs in and grabs the softer brass knife edge requiring more and more effort to operate the lever mechanism. This can be visually confirmed by the grooves that each of the fingers eventually wears into the brass knife edge; 2—the lever mechanism only unseats the knife edge on the strike side of the door requiring the operator to manually pull the door's knife edge completely out of the narrow channel and finger stock seal at the top, bottom and hinge side and to push the door in until the lever mechanism can be engaged.

Very high maintenance is required for the narrow channel knife edge door design. In particular, weekly flushing of the narrow channel with solvents is required to remove loose dirt. In addition, weekly lubrication with conductive lubricant of the finger stock seal in the narrow channel is recommended. For the reasons discussed above, monthly or quarterly replacement of finger stock seal occurs—with associated down time—based upon usage of the knife edge door. Finger stock seal replacement requires special tools and takes approximately 1 hour. Moreover, monthly or quarterly lubrication of the mechanical operating mechanism is required based upon usage.

Additional problems with the narrow channel knife edge design arise because the brass knife edge can be bent causing misalignment—which makes the door difficult if not impossible to operate and causes a loss of shielding effectiveness. Similarly, the knife edge at the sill cannot be stepped on as damage will occur. The sill must be protected by a steel plate or wood ramp of sufficient strength if furniture, fixtures or supplies need to be wheeled or carted through the door.

SUMMARY OF THE INVENTION

The present invention avoids the disadvantages of the narrow channel knife edge design by machining a wide channel in the bar stock material after attachment to the door frame, which resulting in a straight channel without any undesired run out. The wide channel allows a gap between the beryllium copper finger stock seals within the wide channel when the door is open making cleaning the channel and finger stock seals easier without the need to remove the finger stock seals. An alternative embodiment includes a third strip of beryllium copper finger stock seals attached to the base of the channel for increased electrical conductivity or the addition of weather seals for exterior applications. Prior to this invention, all knife edge doors are made from extruded brass shapes in the form of knife edges and channels.

BRIEF DESCRIPTION OF THE DRAWINGS

The present invention is illustratively shown and described in reference to the accompanying drawings, in which.

DETAILED DESCRIPTION OF THE INVENTION

In general, the present invention is a wide channel door frame cooperating with a wide width knife edge of a door and latching mechanism: to accommodate a gap between finger stock seals when the wide knife edge door is in the open position, to provide electrical connectivity between the door and door frame when the wide knife edge door is received into the wide channel door frame in the closed position, to accommodate ease of manufacturing a straight channel, to accommodate ease of cleaning the channel after installation of the finger stock seals, and to accommodate ease of closing/latching and opening/delatching the door.

Figure 1:
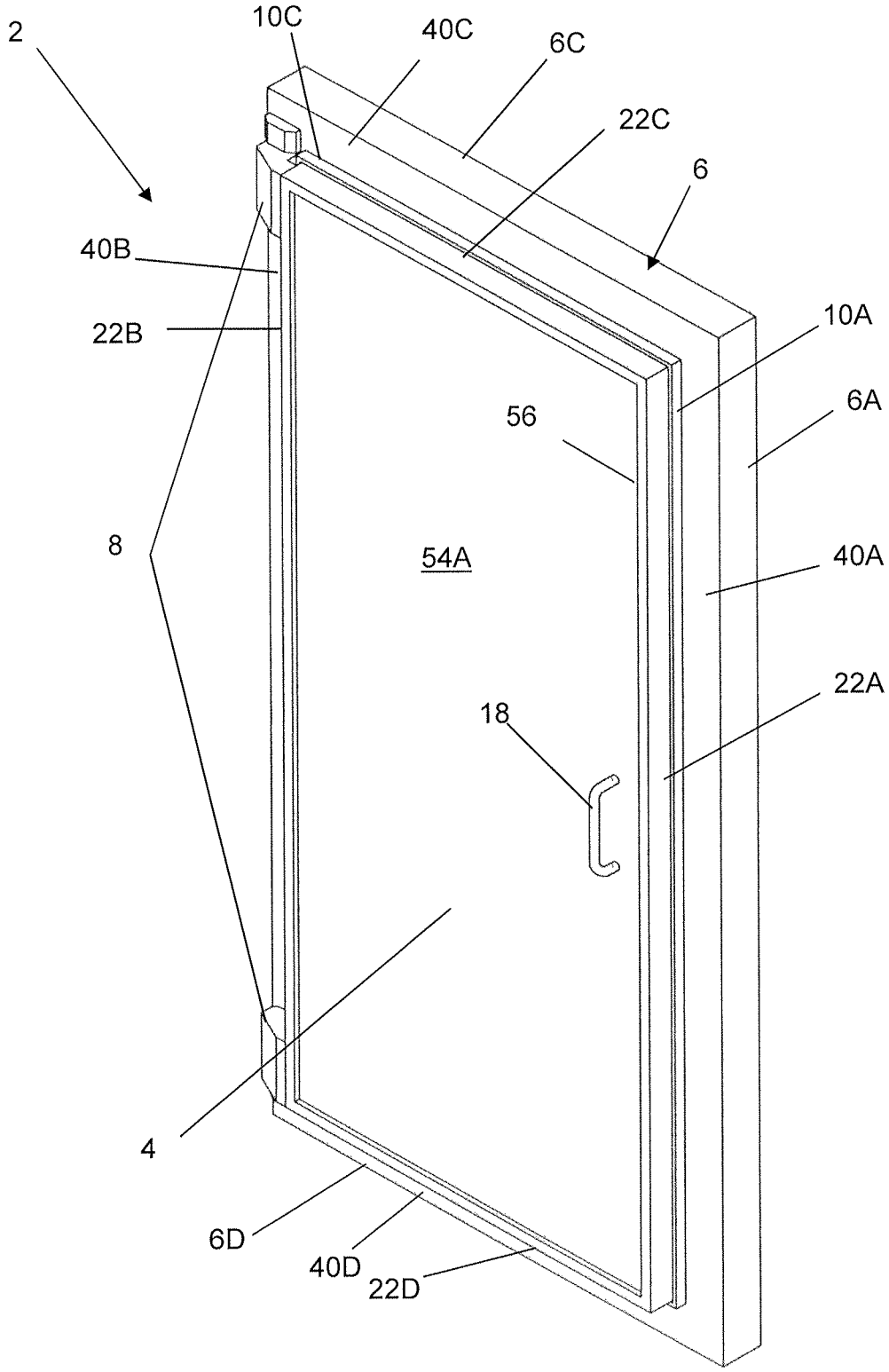
FIG. 1 is a perspective view of the wide channel knife edge door system of the present invention in the closed position illustrating exemplary components of the system.
Figure 2:
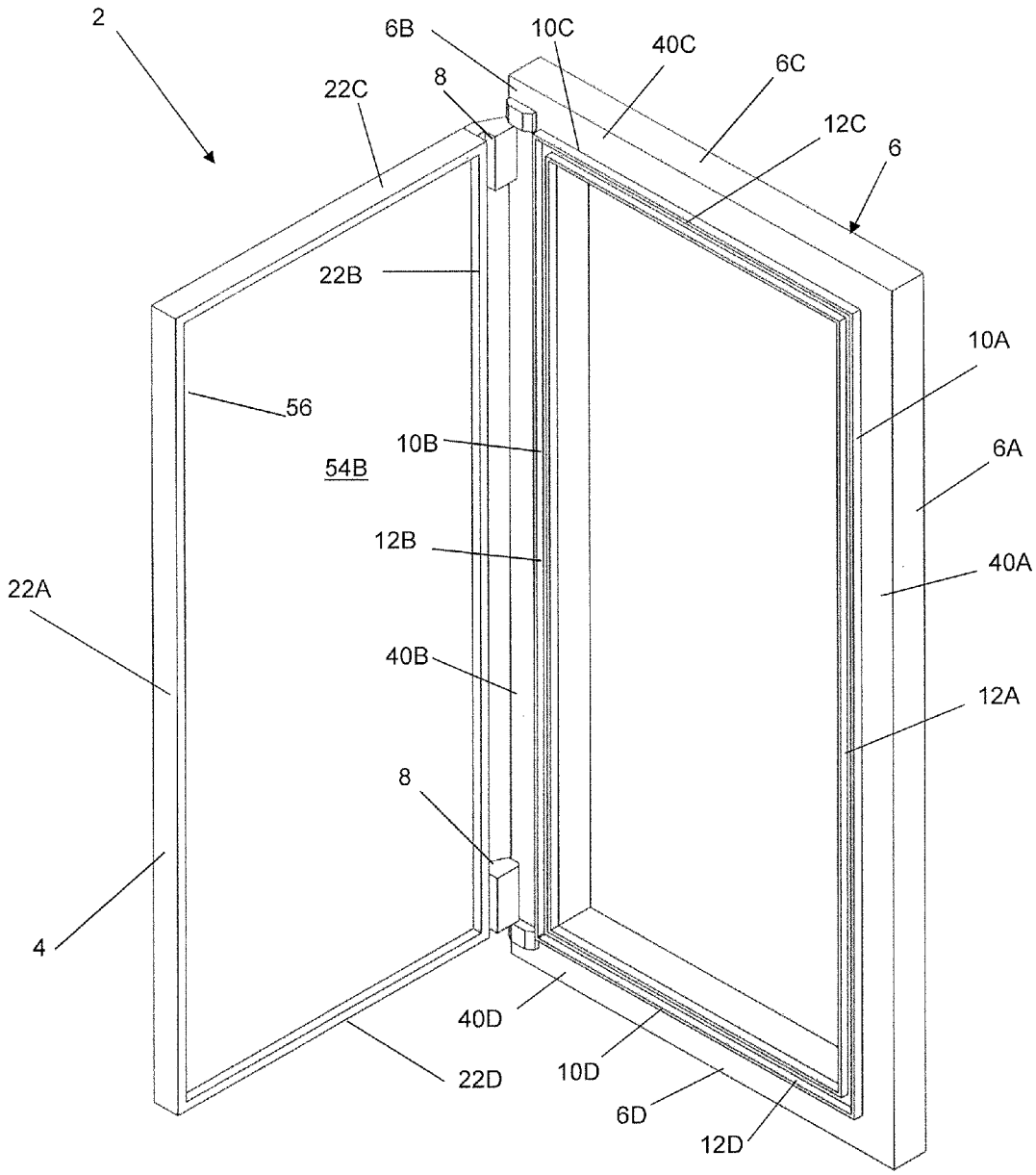
FIG. 2 is a perspective view of the wide channel knife edge door system of the present invention in the open position illustrating exemplary internal interfacing components of the system.
Figure 3:
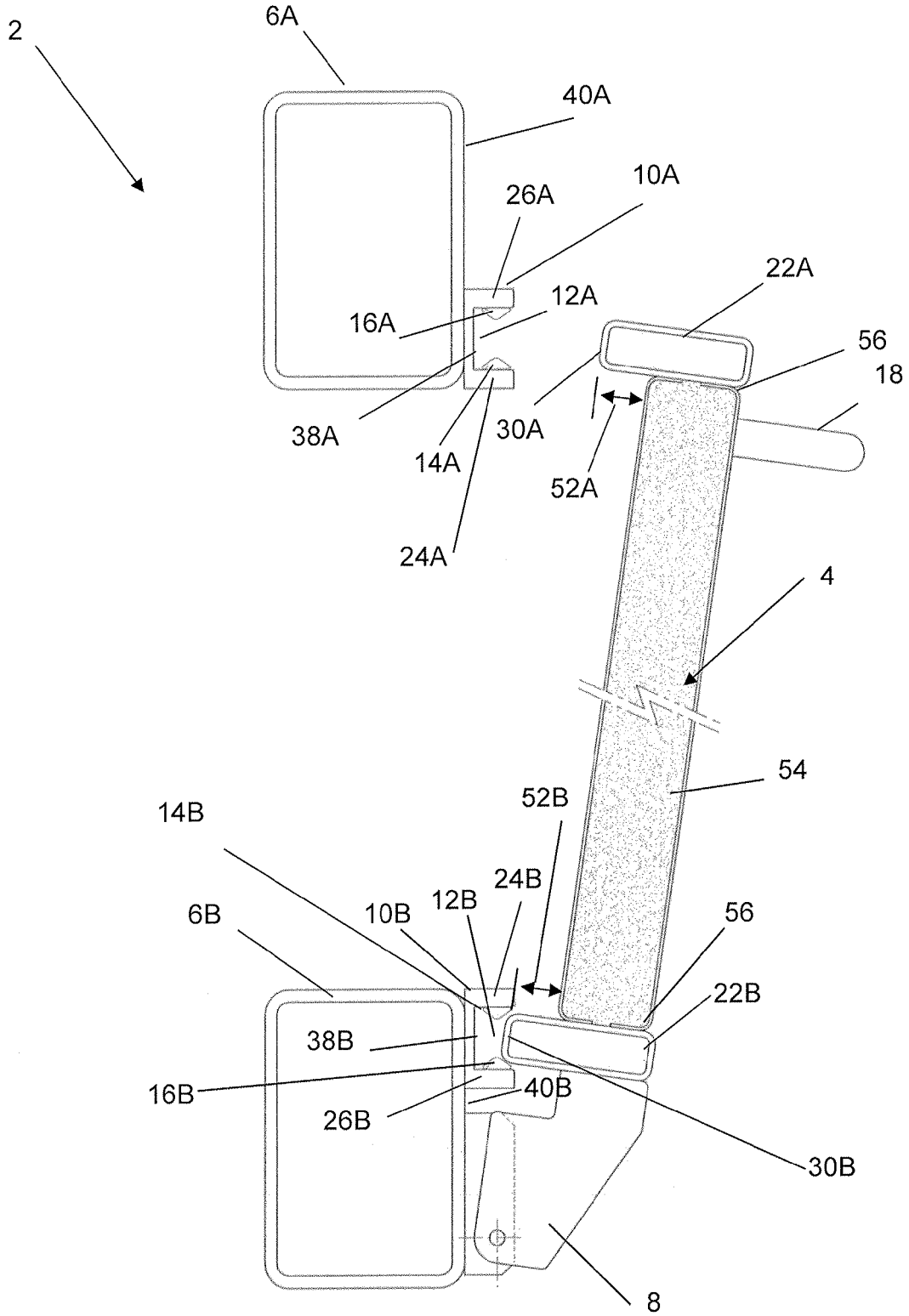
FIG. 3 is a cross-sectional top view of the present invention in a partially opened position.

FIGS. 1 and 2 illustrate one embodiment 2 of the present invention in a closed position (FIG. 1) and in an opened position (FIG. 2). Door 4 includes outside panel 54A, inside panel 54B, hinge 8 pivotally attached to door frame 6 and door 4, handle 18 attached to outside panel 54A and inside panel 54B (not shown), and knife edges 22A, 22B, 22C, 22D attached along perimeter outer surface 56 of door 4. An alternative embodiment can attach the knife edges to the inside panel 54B as well as perimeter outer surface 56 as shown herein. Door system 2 includes door frame 6 with four sides 6A, 6B, 6C, 6D and corresponding wide channel frames 10A, 10B, 10C, 10D attached to its respective side.

Now turning to FIGS. 3, 4, 6, 7, 8, and 9, wide channels 12A, 12B, 12C, 12D are machined after wide channel frames 10A, 10B, 10C, 10D are attached to its respective front surface 40A, 40B, 40C, 40D of door frame 6. Wide channels are defined by inner channel wall 24A, 24B, outer channel wall 26A, 26B, and channel base 38. Generally, a channel can include two opposing sides (inner channel wall and outer channel wall) with a channel width 20 therebetween. Channel base 38 can be perpendicularly oriented to the two opposing sides 24A, 24B, 26A, 26B and can be opposite a channel opening 50, wherein wide channels 12A, 12B, 12C, 12D include a depth 48 measured from opening 50 to channel base 38. One embodiment of the channel and knife edges is in the form rectangles or squares.

Figure 5:
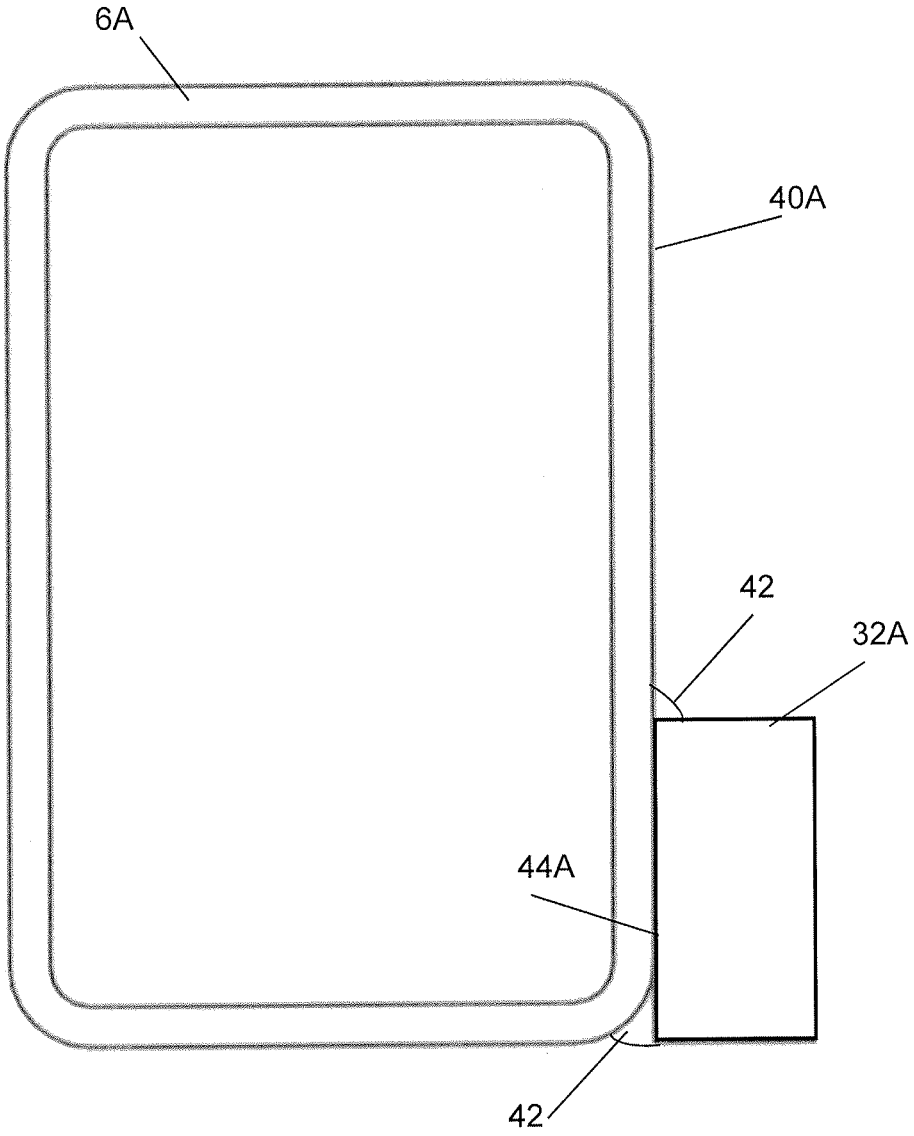
FIG. 5 is a cross-sectional view of an exemplary door frame assembly with a channel raw stock material attached to the door frame prior to machining of a channel.

The machining operation of wide channels 12A, 12B, 12C, 12D can be performed in multiple steps or as a single continuous step. An example of the wide channel manufacturing process is illustrated in FIG. 5. Back surface 44A of channel raw stock material 32A is attached to front surface 40A of door frame 6A utilizing conventional attachment procedures, such as welding represented by weld bead 42. The flexible machining procedure allows for a single channel to be cut up to all four perpendicularly and opposing wide channel frames being cut in any order. However, system 2 is most efficiently manufactured when the wide channel cutting operation is performed during a single manufacturing operation making the right-angle or perpendicular turning at mating corners of the channel raw stock material 32A to adjust the machining path without interruption of the operation.

Figure 6:
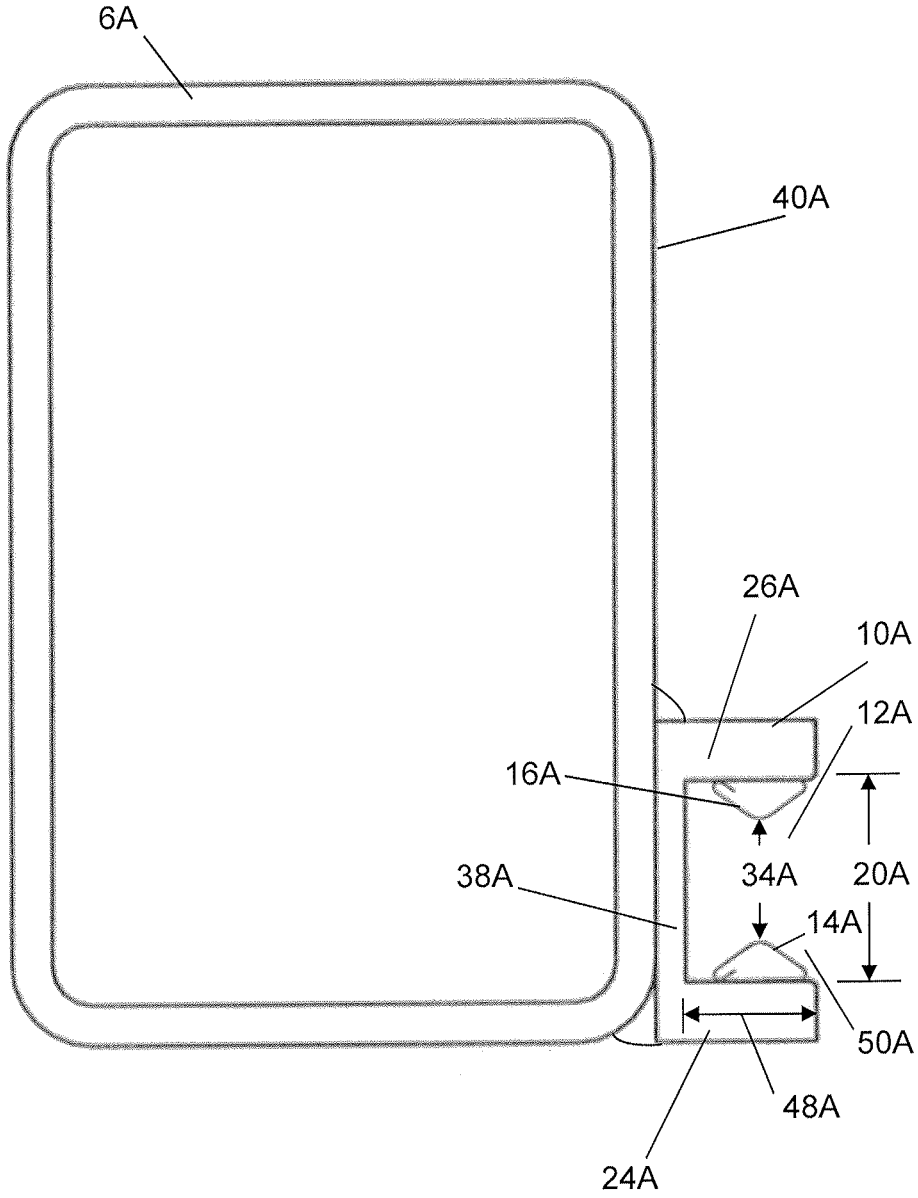
FIG. 6 is a cross-sectional view of an exemplary door frame assembly with a door frame attached to a wide channel with finger stock seals in a relaxed state attached therein the wide channel.
Figure 7:
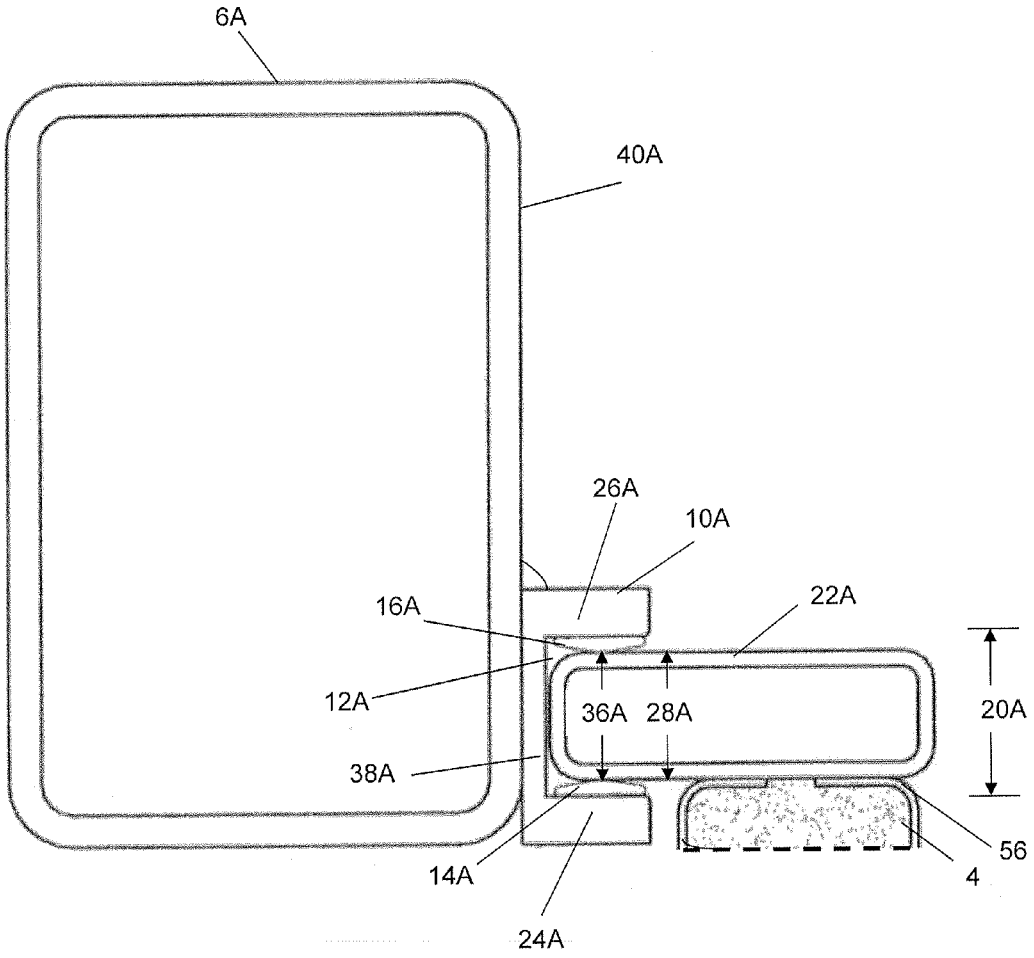
FIG. 7 is a cross-sectional view of the exemplary door frame assembly of FIG. 6 with a door knife edge of a door received into the channel and engaged with the finger stock seals.
Figure 8:
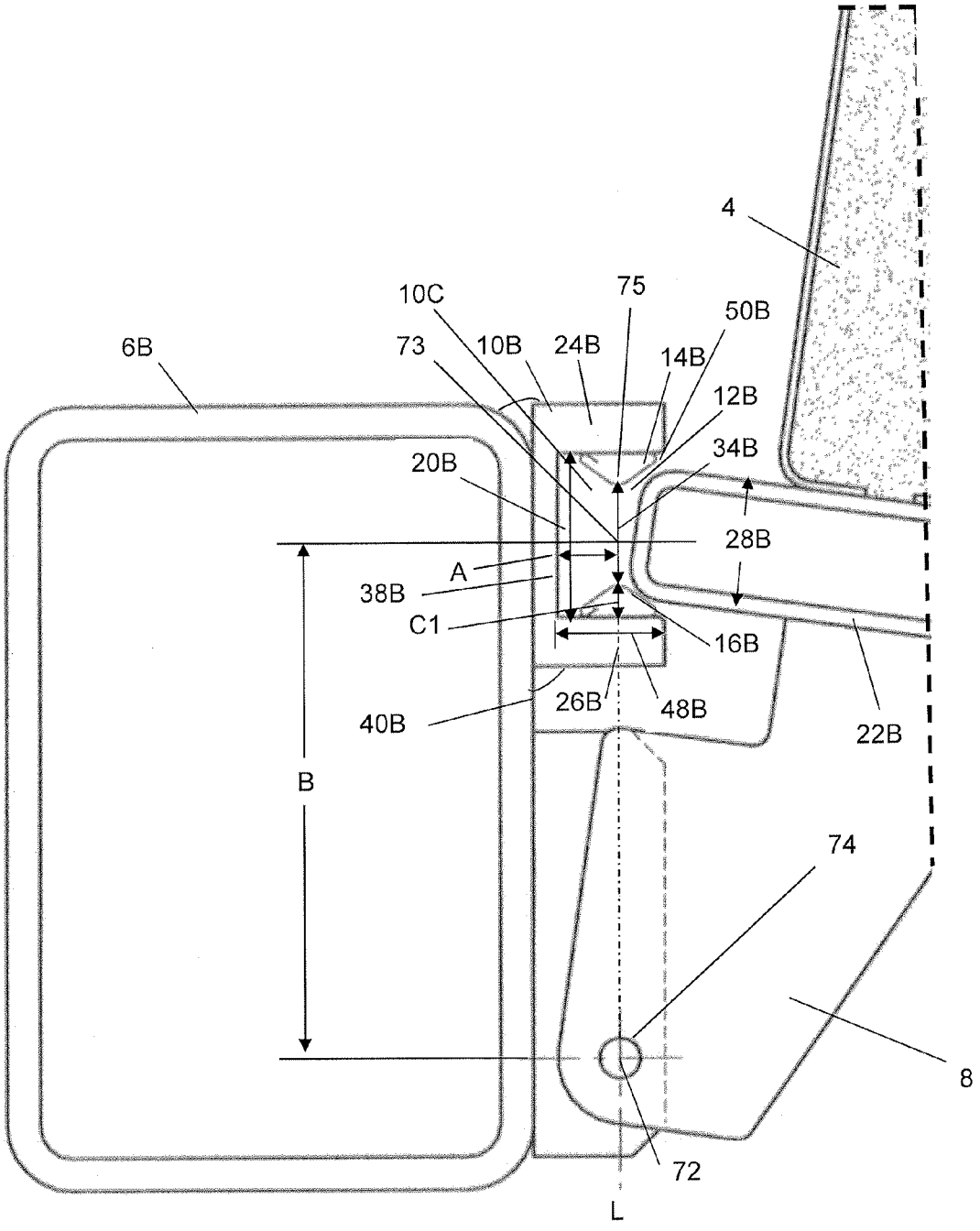
FIG. 8 is a cross-sectional view of an exemplary door frame assembly on the hinge side with finger stock seal in a relaxed state attached therein the wide channel prior to receiving a door knife edge of a door.
Figure 9:
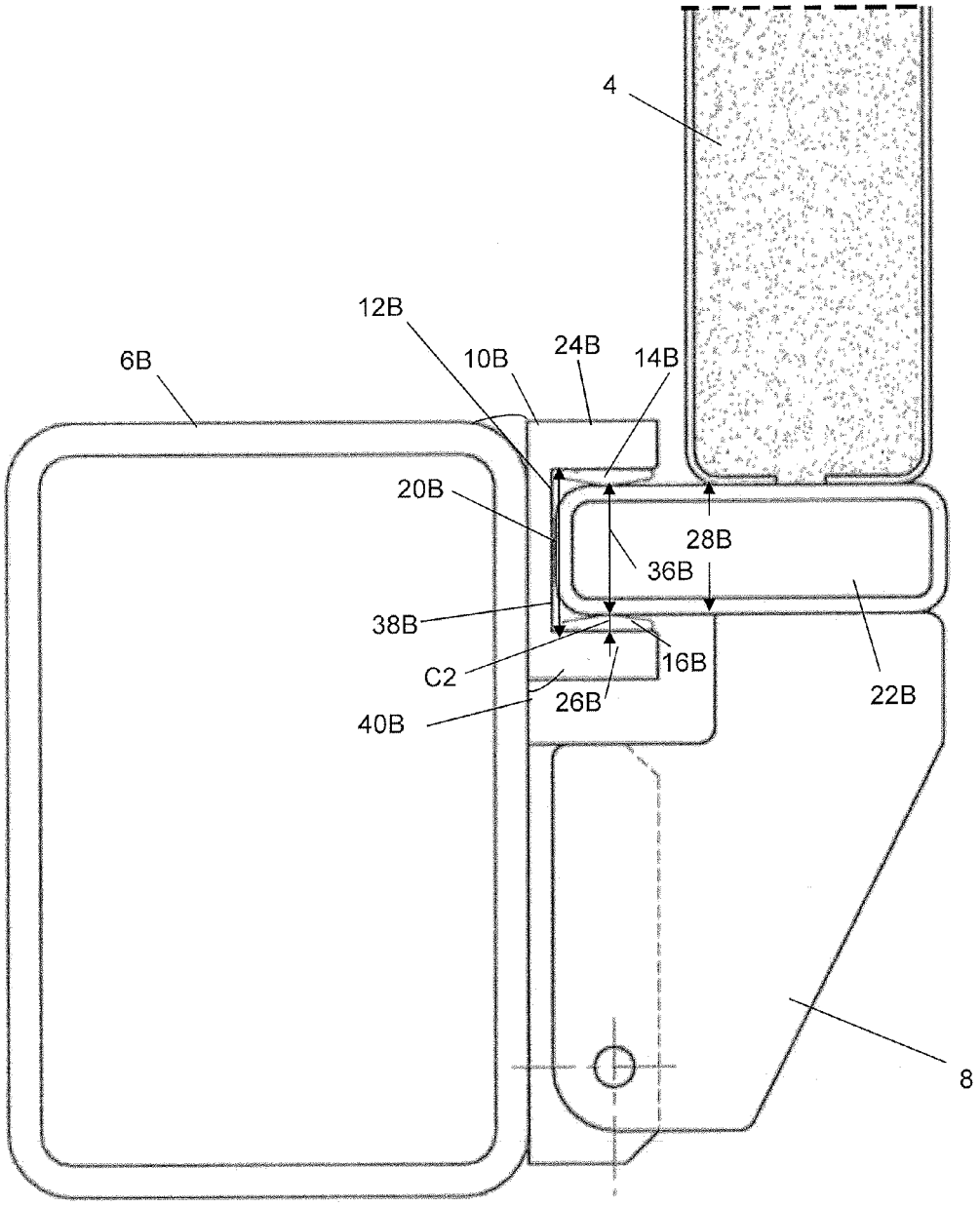
FIG. 9 is a cross-sectional view of the exemplary door frame assembly on the hinge side with a door knife edge of a door received into the channel and engaged with the finger stock seals.
Figure 10:
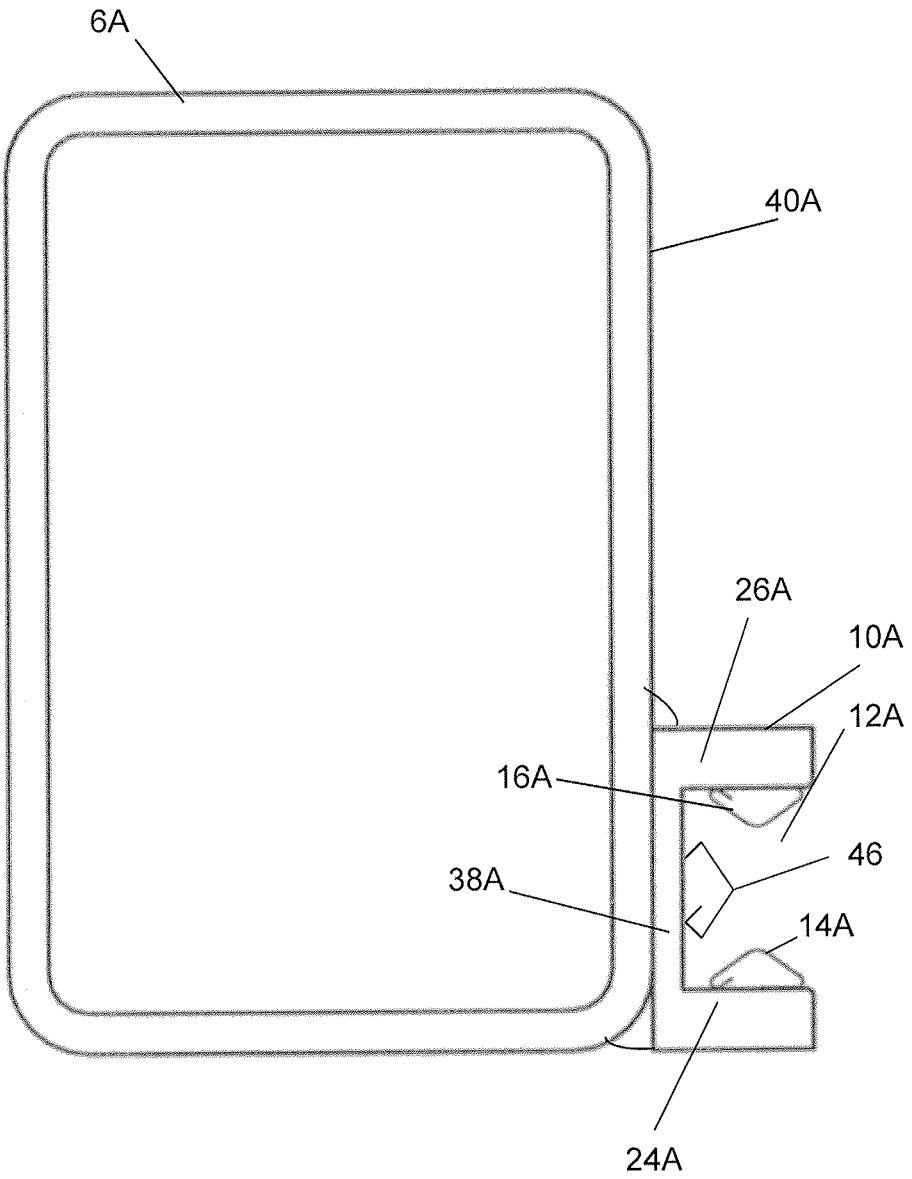
FIG. 10 is another embodiment of the present invention illustrating the finger stock seal attached to a channel base.

After completion of the wide channel 12A, 12B, 12C, 12D cutting operation, inner and outer finger stock seals are installed into the wide channel. Though the illustrations herein in FIGS. 3, 4, 6, 7, 8, 9, 10 only show inner finger stock seals 14A, 14B and outer finger seals 16A, 16B installed into wide channels 12A, 12B, equivalent inner and outer seals not shown can also be installed into wide channels 12C, 12D. One embodiment of finger stock seals include an adhesive strip attached to its side adjacent to the wide channel to which the finger stock seal is to be attached. Once finger stock seals 14A, 14B, 16A, 16B are attached to each respective opposing side, relaxed gap 34A, 34B is formed between the tips of finger stock seals 14A, 14B, 16A, 16B (FIGS. 6 and 8). Another embodiment of system 2 is illustrated in FIG. 10 that includes finger stock seal 46 attached to channel base 38A. Though FIG. 10 illustrates three (3) finger stock seals, any combination of two (2) seals are sufficient for electrical conductivity, such as finger stock seals 16A, 46 or 14A, 46 or 16A, 14A. Another embodiment of the present invention includes the addition of weather seals (not shown) along channel base 38 for exterior applications.

Now turning to FIGS. 3, 4, 7, 8, and 9, knife edges 22A, 22B have widths 28A, 28B being less than channel width 20A, 20B and being greater than finger stock seal relaxed gap 34A, 34B. Knife edges 22A, 22B having tips 30A, 30B with lengths 52A, 52B, respectively, equal to or less than the channel depth 48A, 48B, respectively. In operation, tips 30A, 30B are received into openings 50A, 50B and knife edges 22A, 22B to compress inner finger stock seals 14A, 14B and outer finger seals 16A, 16B inward toward a side the seal is attached to form a finger stock seal compressed gap 36A, 36B (FIGS. 7 and 9) and an electrical connection between the door 4 and the door frame 6 when the door 4 is in a closed position. The difference between the compressed gap 36A, 36B and relaxed gap 34A, 34B is the total compression of the finger seals 14A, 16A, and 14B, 16B, respectively, or and finger stock seals 14A, 14B and outer finger seals 16A, 16B spring back or decompress to substantially form relaxed gap 34A, 34B when door 4 is in an opened position. One embodiment of the present invention none of the finger seals 14A, 16A, 14B, 16B are fully compressed where C1 equal zero (see FIG. 8). A further illustration of the finger stock seals is the distance from internal side of the channel to the peak bend of the finger stock seal denoted as C1 (FIG. 8) in the relaxed position and denote as C2 (FIG. 9) in the compressed position. Compression of a single finger stock seal is C3=C1-C2. Therefore, total compression Ctotal of the finger stock seals for a single wide channel is Ctotal=C3 left side+C3 right side. Total compression Ctotal also equals the difference between finger stock seal compressed gap 36A, 36B and finger stock seal relaxed gap 34A, 34B.

Figure 4:
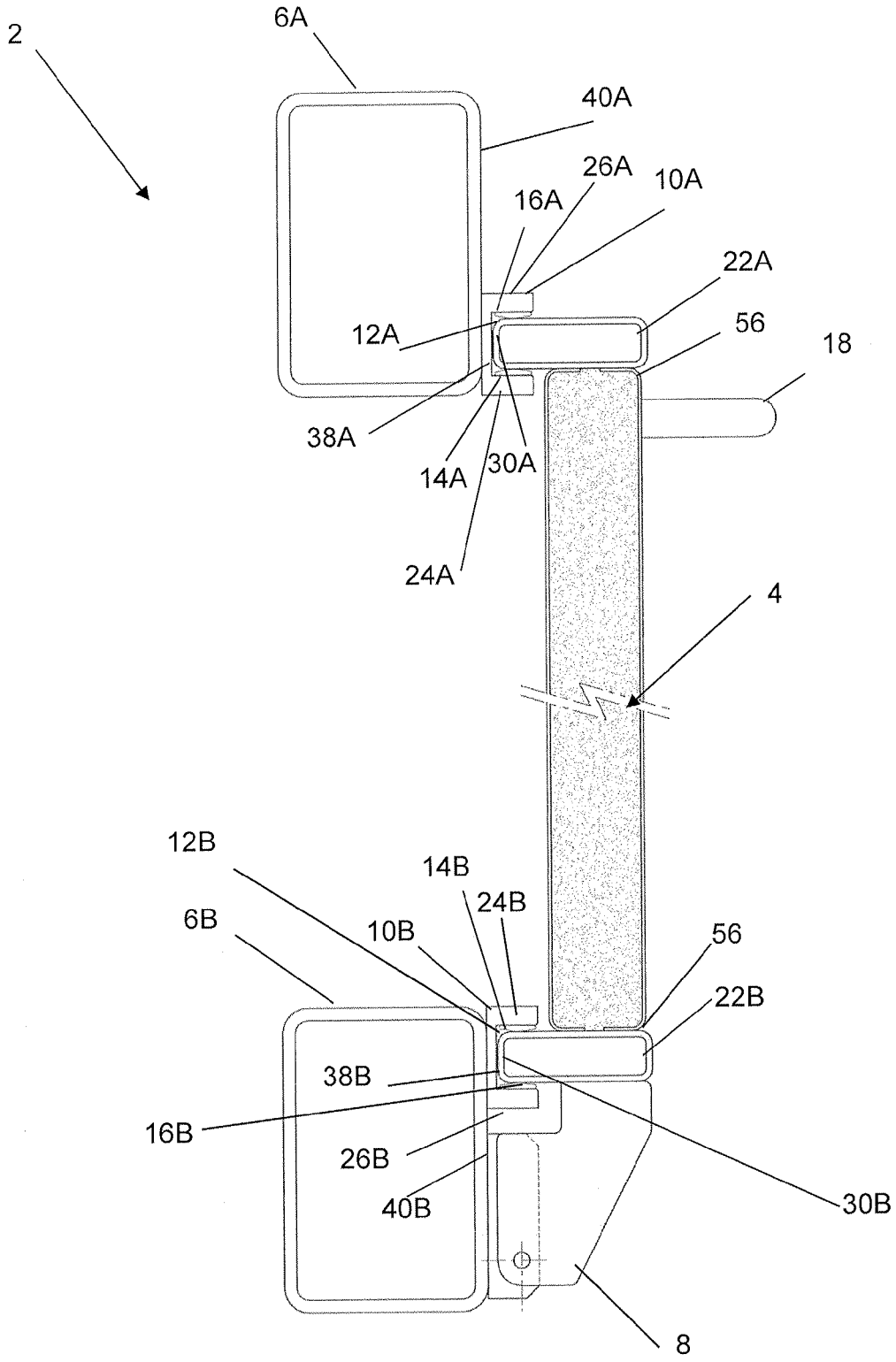
FIG. 4 is a cross-sectional top view of the present invention in a closed position.

Now turning to FIG. 8, another embodiment of the present invention sets a pre-determined ratio (for example 8:1) B:A defined as the distance B between the center 72 of hinge pivot point 74 of hinge 8 and intersection point 73 within wide channel 12B along longitudinal plane L, and depth A of wide channel frame 10B measured from intersection point 73 to channel base 38A, 38B. Longitudinal plane L passes through center 72 of hinge pivot point 74 of hinge 8 and the peak bend 75 of finger stock seals 14B, 16B. This dimensional relationship provides for precise alignment of knife edges knife edges 22A, 22B, 22C, 22D with inner channel wall 24A, 24B, outer channel wall 26A, 26B, and channel base 38, such that no damage is caused to the knife edges 22A, 22B, 22C, 22D, inner channel wall 24A, 24B, outer channel wall 26A, 26B, and channel base 38, and finger stock seals 14A, 14B, 16A, 16B as shown in FIG. 4. Though the illustrated B:A ratio is about 8:1, the ratio can also range from 7:1 to 9:1, 7.5:1 to 8.5:1, 7.9:1 to 8.1:1, 8:1 to 32:1.

Wide channels can be made of stainless steel (for example 304 stainless steel), brass, bronze, aluminum, or any suitable material with the desired electrical conductivity characteristics. Door frames can be made of any suitable material, such as carbon steel and stainless steel, attachable to the wide channel. Knife edges can be stainless steel tubing or solid, monolithic parts, for example 304 stainless steel. It is against accepted convention to use 304 stainless steel due to it's difficulty to machine and its lower surface electrical conductivity. However, 304 stainless steel corrodes at a much lower rate due its better oxidation properties than the other materials, and therefore its electrical conductivity degrades at lower rate when exposed to a corrosive environment and maintains substantially a constant surface electrical conductivity.

Figure 11:
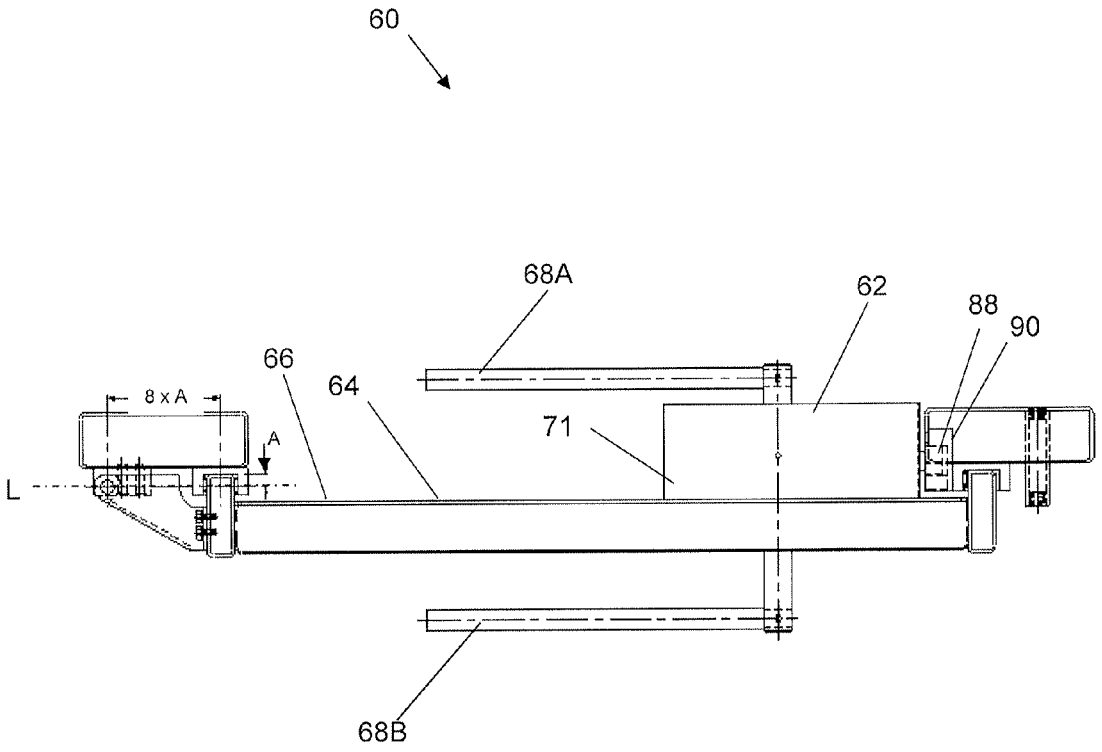
FIG. 11 is a top view of another embodiment of the present invention having a door movement and latching mechanism in the closed position.
Figure 16:
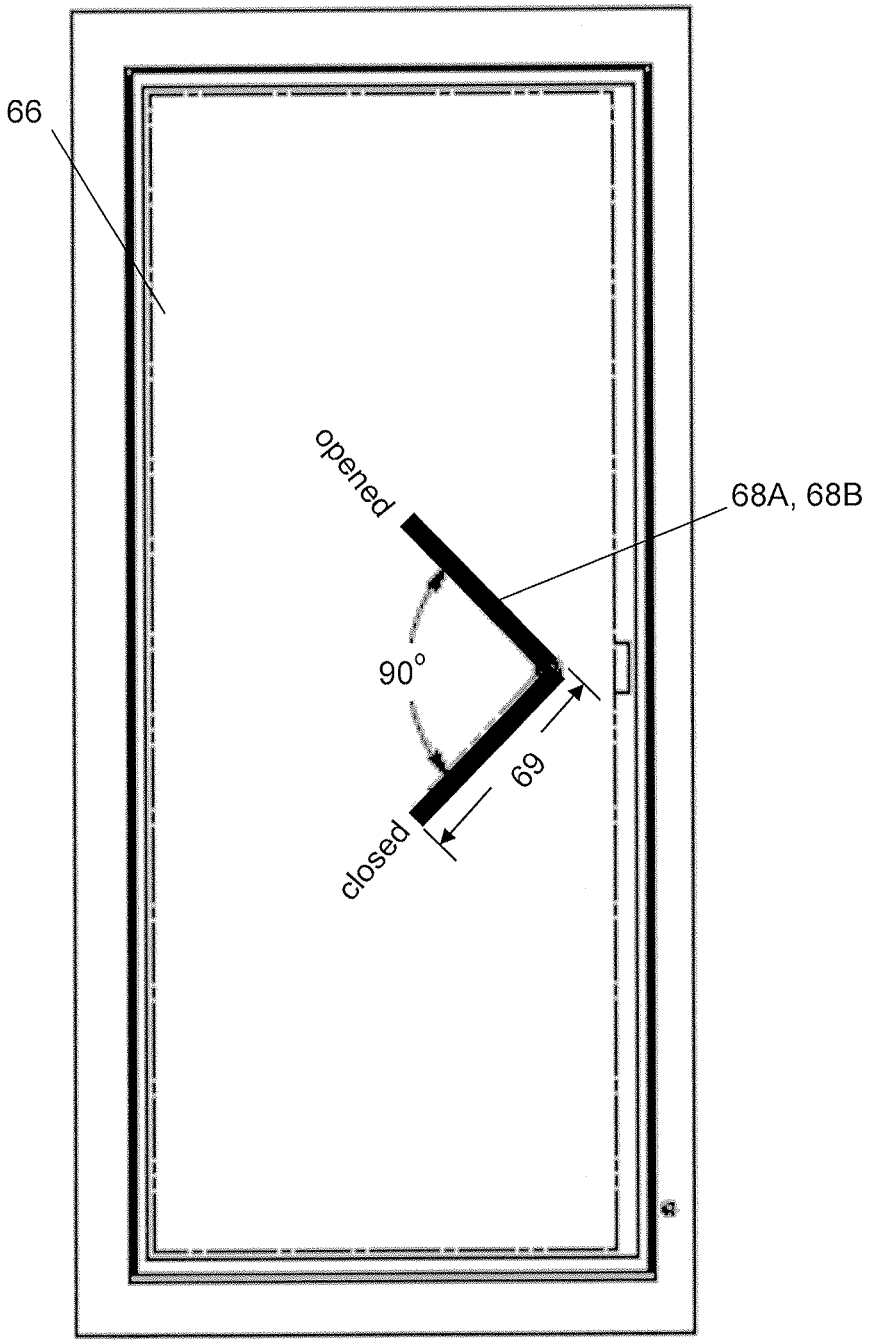
FIG. 16 is front view of the outside of the door illustrating an exemplary range of motion of the handle from open to closed position.

Now turning to FIG. 11 that illustrates another embodiment 60 of the present invention having a door movement and latching mechanism 62 attached to the rear surface 64 of door 66. Inside door handles 68A and outside door handles 68B are pivotable connected to latching mechanism 62 by shaft 70, and either handle can actuate the mechanism 62. Cam follower 88 is connected to mechanism 62 and is shown seated within cam striker 90, which is attached to door frame 92. Mechanism 62 is capable of drawing door 66 towards door frame 92 and engaging door 62 with door frame 92 to secure door 66 with a single movement of either handle 68A, 68B in one direction, and capable of disengaging door 66 from door frame 92 and pushing door 66 away from door frame 92 to open door 66 with a single movement of either handle 68A, 68B in the opposite direction. The bi-directional functionality of handle 68A, 68B is illustrated in FIG. 16. Length 69 of handle 68A, 68B can be any size to accommodate the size of door 66, vertical translation distance 108, and horizontal translation distance 110, discussed in detail below.

Figure 12:
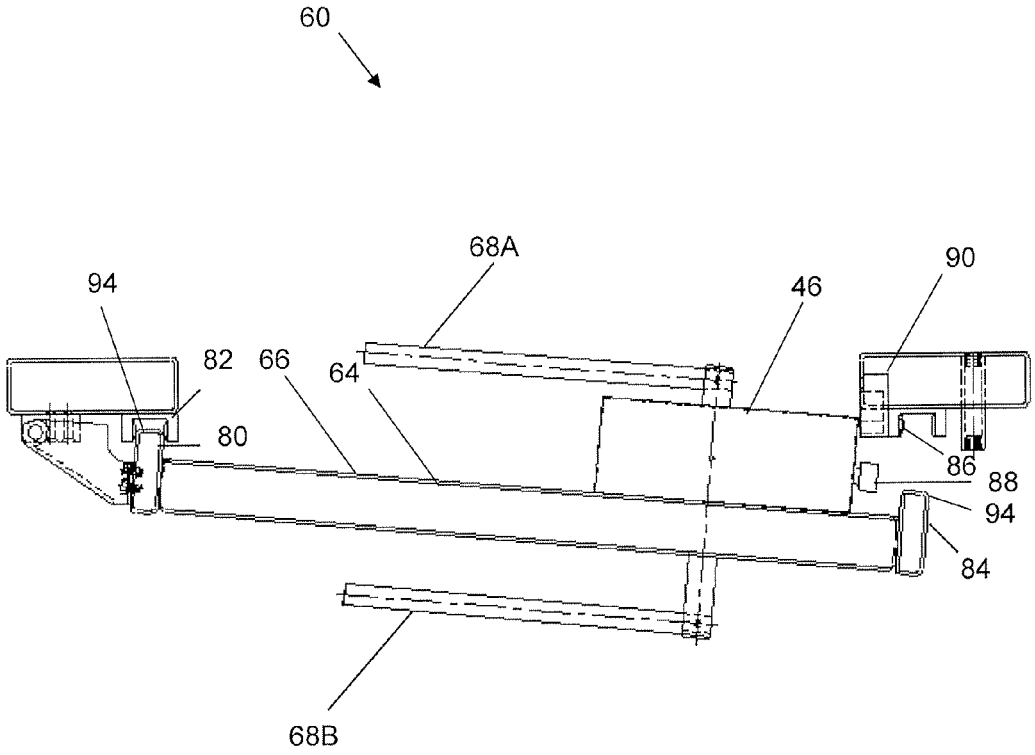
FIG. 12 is a top view of the present invention illustrated in FIG. 11 in the open position.

FIG. 12 illustrates head 94 of knife edge 80 entering wide channel frame 82 such that the finger stock seals are compressed substantially equally as the knife edge 80 completes its travel into the wide channel frame 82. The hinge-wide channel dimensional relationship described above also holds true for the alignment of head 96 of knife edge 84 with wide channel frame 86.

Figures 13A, 13B:
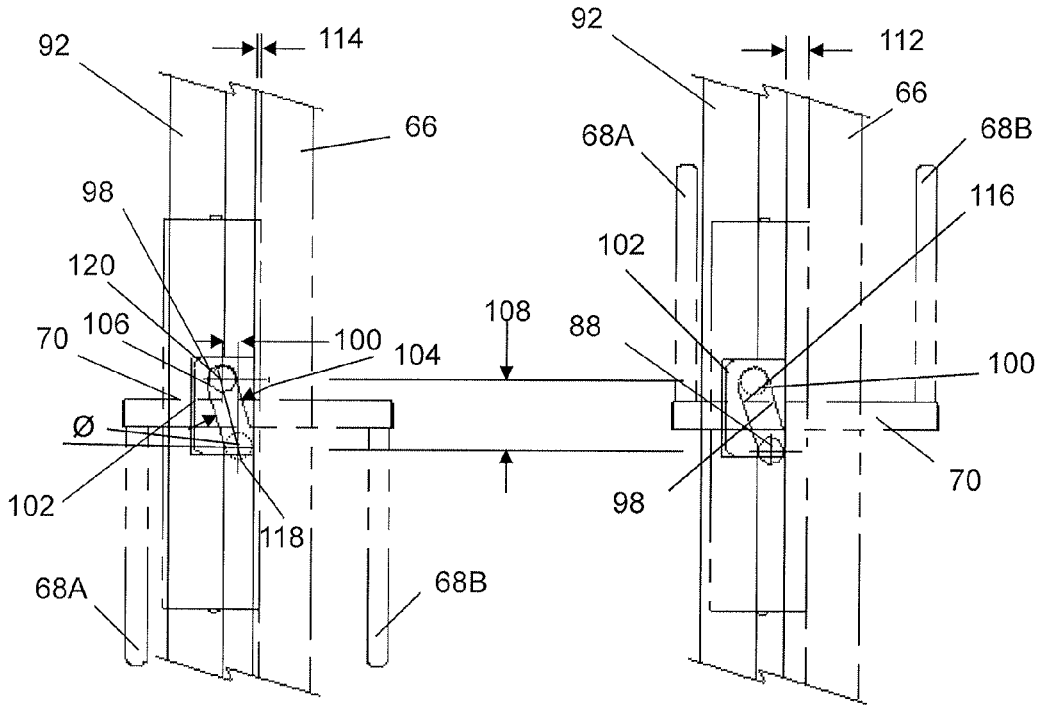
FIG. 13A is a side view of the present invention illustrated in FIG. 11 showing the cam roller in the closed position.
FIG. 13B is a side view of the present invention illustrated in FIG. 12 showing the cam roller in the open position.

FIGS. 13A and 13B illustrate cam follower 88 in a closed and open position, respectively. As handles 68A, 68B are rotated from an open to closed position, cam follower 88 is vertically translated upward a distance 108 causing the cam follower 88 to contract upper edge 98 of angled slot 100 of cam strike 102 to draw the door 66 into frame 92 a horizontal distance 110 from an open point 112 to a closed point 114. As handles 68A, 68B are rotated from a closed to an opened position, cam follower 88 is vertically translated downward a distance 108 measured from the center 120 of cam follower 88 causing the cam follower 88 to contract lower edge 116 of angled slot 100 of cam strike 102 to push the door 66 away from frame 92 a horizontal distance 110 from close point 114 to open point 112. Angled slot 100 has a predetermined width 104 that is larger than diameter 106 of cam follower 88. Angled slot 100 has a slot length 118. Angle slot 100 has an angle θ from horizontal. The cam strike 102 can have varying slot lengths 118, slot angle θ, vertical translation distances 108, and horizontal translation distances 110 depending on user's need for opening door 66.

Figure 14:
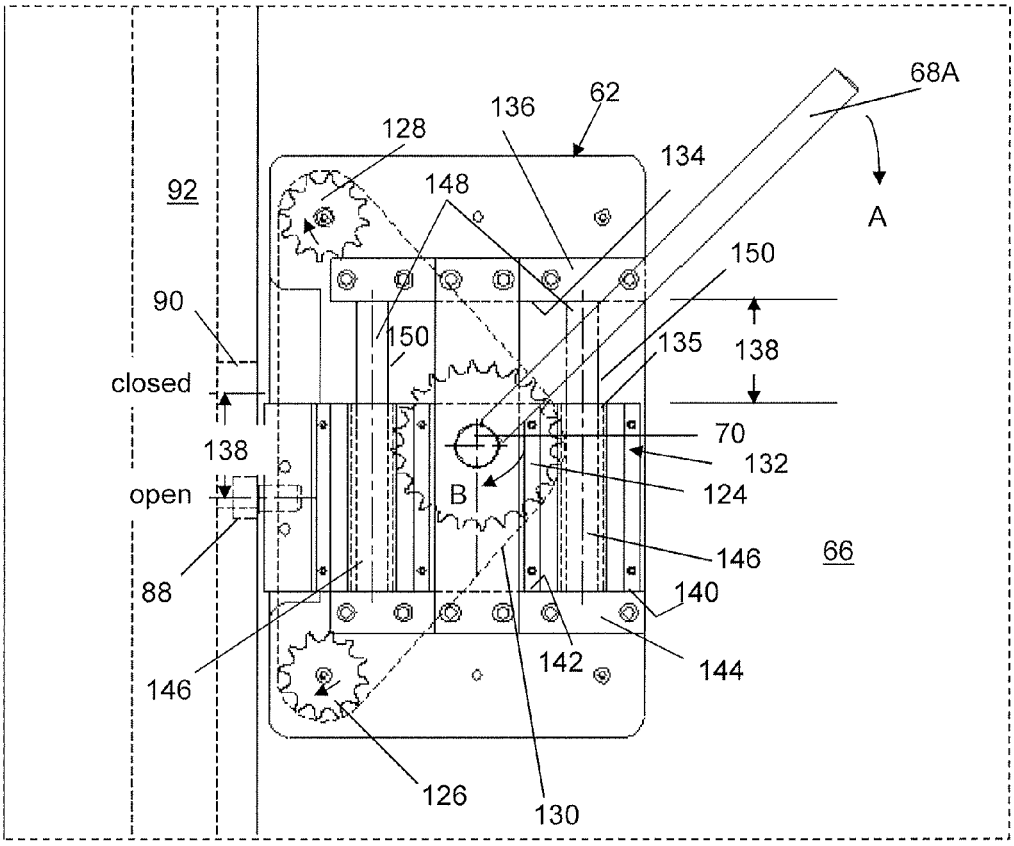
FIG. 14 is a side view of the door movement and latching mechanism without the cover showing the cam roller in the open position.

FIG. 14 is a side view of door movement and latching mechanism 62 without the cover showing the cam follower 88 in the open position. One embodiment of mechanism 62 only requires a single point latch for a man-size door, which is defined as a door height of up to 8 feet and door width of up to 4 feet. However, largers door may require more than one mechanism 62. Door movement and latching mechanism 62 includes a housing 71 capable of being attached to the door; drive sprocket 124 rotationally connected to housing 71 and connected to handle 68A, 68B; a pair of vertically aligned idler sprockets 126, 128 rotationally connected to housing 71; a sprocket engaging device 130 that links door movement and latching mechanism 62 to drive sprocket 124; plate 132 is connected to sprocket engaging device 130; and cam follower 88 connected to plate 132, wherein cam follower 88 moves up and down in response to the movement of either handle 68A, 68B. As handle 68A is rotated in direction A, drive sprocket 124 rotates in direction B to simultaneously rotates vertically aligned idler sprockets 126, 128 in the same direction interconnected by a chain 130 or equivalent linking mechanism to move plate 132 toward to contact upper edge 135 of plate 132 with bottom surface 134 of upper mounting bar 136 at a predetermined distance 138 to engage cam follower 88 in cam strike 90 attached to frame 92 to close and latch door 66 to frame 92. The reverse action is required to open and unlatch door 66 from frame 92 such that lower surface 140 of plate 132 contacts upper surface 142 of lower mounting bar 144. To facilitate the ease of rising and lowering plate 132, conventional pillow blocks 146 are attached to plate 132 having an internal bore sized to tightly retain shafts 148 to prevent lateral movement while providing freedom of movement longitudinally along outer surface 150 of shafts 148. The mechanism 62 is mass balanced and internal bearing friction such that handles 68A, 68B do not move due to gravity or vibration in any position.

Figure 15:
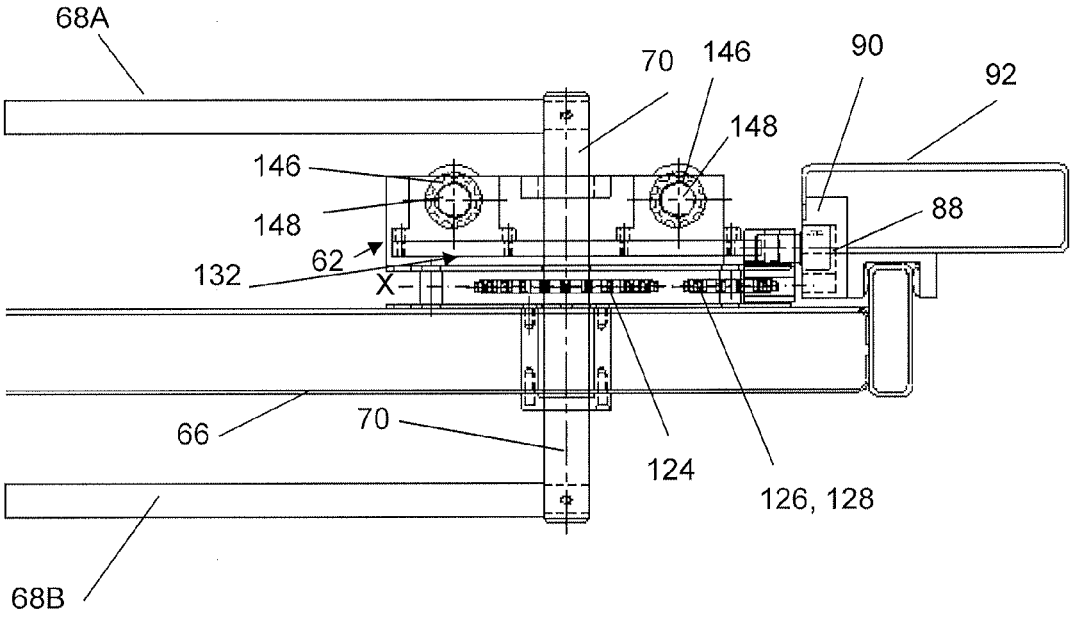
FIG. 15 is a top view of the door movement and latching mechanism with the cover showing the cam roller in the closed position.

FIG. 15 is a top view of the latching mechanism 62 with the cover showing the cam roller 88 in the closed position within cam strike 90 and illustrating many of the features shown in FIG. 14. Drive sprocket 124 and vertically aligned idler sprockets 126, 128 are longitudinally align in plane X.

FIG. 16 illustrates one embodiment of the present invention with handles 68A, 68B having a pivotal rotation, for example, of 90 degrees. The pivotal rotation can be any desireable range to accommodate any size door 66.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A knife edge door system comprising:

a door frame with a channel, the channel comprising a first piece of stainless steel stock material attached to the door frame and a first machined channel in the first piece of stainless steel stock material, the channel having two opposing sides with a width therebetween, and a channel base perpendicularly oriented to the two opposing sides and opposing an opening in the channel, wherein the channel includes a channel depth measured from the opening to the channel base;

two opposing finger stock seals, wherein one finger stock seal of the two opposing finger stock seals is attached to each side of the two opposing sides of the channel to form a finger stock seal relaxed gap therebetween, wherein each finger stock seal of the two opposing finger stock seals comprises a peak bend;

a door having a knife edge with a width less than the channel width and greater than the finger stock seal relaxed gap, wherein the knife edge having a length equal to or less than the channel depth; and a hinge pivotally connecting the door and the door frame, wherein the hinge comprises a single pivotal center point along a single plane that passes through the peak bends of the two opposing finger stock seals, wherein the knife edge of the door compresses the two opposing finger stock seals inward toward the side it is attached thereto to form a finger stock seal compressed gap therebetween and an electrical connection between the door and the door frame when the door is in a closed position, and the finger stock seal springs back or decompresses to substantially form the finger stock seal relaxed gap when the door is in an opened position.

2. The system according to claim 1, the channel further comprising:

at least one additional piece of stainless steel stock material attached to the door frame to form a perimeter around the door frame, and an additional machined channel in the at least one additional piece of stainless steel stock material.

3. The system according to claim 2, wherein the first machined channel in the first piece of stock material and the additional machined channel in the at least one additional piece of stock material are created in one continuous operation.

4. The system according to claim 1, wherein the stainless steel stock material is 304 stainless steel.

* * * * *